US010806176B2

(12) United States Patent
Bonetti Baroggi

(10) Patent No.: US 10,806,176 B2
(45) Date of Patent: Oct. 20, 2020

(54) SYSTEM FOR THE CONTROLLED DISPENSATION OF CIGARETTES

(71) Applicant: ICANDO S.R.L., Milan MI (IT)

(72) Inventor: Alberto Bonetti Baroggi, Varese VA (IT)

(73) Assignee: ICANDO S.R.L., Milan (IT)

( * ) Notice: Subject to any disclaimer, the term of this patent is extended or adjusted under 35 U.S.C. 154(b) by 24 days.

(21) Appl. No.: 16/321,917

(22) PCT Filed: Aug. 3, 2017

(86) PCT No.: PCT/IB2017/054761
§ 371 (c)(1),
(2) Date: Jan. 30, 2019

(87) PCT Pub. No.: WO2018/025219
PCT Pub. Date: Feb. 8, 2018

(65) Prior Publication Data

US 2019/0174821 A1 Jun. 13, 2019

(30) Foreign Application Priority Data

Aug. 5, 2016 (IT) ..... 102016000083125

(51) Int. Cl.
*A24F 15/00* (2020.01)
*E05B 43/00* (2006.01)
*G04G 15/00* (2006.01)

(52) U.S. Cl.
CPC ..... *A24F 15/005* (2013.01); *E05B 43/005* (2013.01); *G04G 15/006* (2013.01)

(58) Field of Classification Search
None
See application file for complete search history.

(56) References Cited

U.S. PATENT DOCUMENTS 8,307,834 B1 * 11/2012 Palmerino, Sr. ..... A24F 15/005 131/270
2001/0027794 A1 * 10/2001 Brue ..... A24F 15/005 131/270
2004/0031498 A1 * 2/2004 Brue ..... G09B 23/28 131/270
2016/0242461 A1 * 8/2016 Rawlins ..... B65D 85/1009

FOREIGN PATENT DOCUMENTS

| | | |
|---|---|---|
| CN | 102 934 840 | 11/2014 |
| DE | 102 11 679 | 9/2003 |
| EP | 2 937 002 | 10/2015 |
| WO | 2015/170018 | 11/2015 |
| WO | 2016/123587 | 8/2016 |

OTHER PUBLICATIONS

International Search Report and written opinion issued by the EPO for PCT/IB2017/054761 dated Sep. 27, 2017.

* cited by examiner

*Primary Examiner* — Gene O Crawford
*Assistant Examiner* — Ayodeji T Ojofeitimi
(74) *Attorney, Agent, or Firm* — Silvia Salvadori

(57) ABSTRACT

A system and method for the controlled dispensation of cigarettes including a container with a logic control unit and an unlocking button by means of which an unlocking request is sent to the logic control unit so that the logic control unit switches a clamping device to an unlocked mode if the unlocking request occurs during one dispensation time interval.

20 Claims, 9 Drawing Sheets

SYSTEM FOR THE CONTROLLED DISPENSATION OF CIGARETTES

This application is a U.S. national stage of PCT/IB2017/054761 filed on 3 Aug. 2017, which claims priority to and the benefit of Italian Application No. 102016000083125 filed on 5 Aug. 2016, the contents of which are incorporated herein by reference in their entireties.

FIELD OF THE INVENTION

The present invention relates to a system for the controlled dispensation of cigarettes. In particular, the present invention mostly finds use in the field of systems and devices to limit or gradually quit smoking for a smoker.

KNOWN ART

It is now widely demonstrated that smoking causes a series of negative effects that can impair health of smokers and people passively suffering their smoking.

Quitting smoking can be very challenging, especially for chronic smokers, which smoke a large number of cigarettes per day (typically more than twenty). There are several methods to inhibit the desire to smoke. Such methods often exploit a pharmacological action adapted to inhibit established receptors. For example by means of chewing gums, plasters etc., the physical dependence on nicotine can be limited. Unfortunately, removing the mental dependence on cigarette is not obtained easily.

By carrying out a test, the Applicant found that most of the smokers, especially the chronic smokers, smoke most of the cigarettes without even noticing it. In particular, by considering a determined number of cigarettes smoked by a sample of smokers, only a very small part of such cigarettes is knowingly smoked, most of the cigarettes are therefore smoked as a not-willed or subconscious action.

SUMMARY OF THE INVENTION

Object of the present invention is to provide a system for the controlled dispensation of cigarettes able to limit the number of cigarettes subconsciously smoked by a smoker, and a method for gradually reducing the total number of smoked cigarettes.

These and further objects are achieved by the present invention by means of a system according to claim 1 and the related dependent claims and a method of dispensing cigarettes by means of the aforesaid system according to claim 15 and the related dependent claims.

According to an aspect of the present invention the system comprises a container of the type provided with at least two portions couplable one to another to define at least one containing housing to contain the cigarettes or a pack of cigarettes. The at least two portions are movable between an open arrangement, in which the containing housing can be accessed from the outside of the container, and a closed arrangement in which the containing housing cannot be accessed from the outside of the container. The open arrangement allows a user to insert inside the container a determined number of cigarettes (possibly a whole pack of cigarettes) and/or to pick up at least one cigarette from the container.

According to an aspect of the present invention, the container comprises a clamping device switchable between a locked mode and an unlocked mode. When the clamping device is in locked mode the switching from the closed arrangement to the open arrangement of the container is prevented, whereas when the clamping device is in unlocked mode the switching from the closed arrangement to the open arrangement of the container, and vice versa, is allowed.

The container further comprises a logic control unit configured to drive the switching of the clamping device. The logic control unit is provided with a programmable timer configured to provide at least one dispensation time interval during which the clamping device is enabled to switch to the unlocked mode.

Characteristic aspect of the present invention is that the system comprises a processing device combined with the container and configured to determine the dependence level of a user through the Fagerström test which is a standard tool to evaluate the intensity of the physical dependence on nicotine. Furthermore, the container comprises a first wireless communicating module, the processing device comprises a second wireless communicating module for transceiving data between the logic control unit of the container and the processing device.

The logic control unit is therefore connected to the first wireless communicating module, preferably Bluetooth (for example BLE—Bluetooth Low Energy), for transceiving information between the container and the processing device combined with the container.

The timer is also automatically programmable by means of the processing device according to the dependence level determined through the Fagerström test. Some embodiments can further provide that the user can manually program the timer of the logic control unit by means of the aforesaid processing device (PC, smart phone, tablet, etc.). For example, by means of a program and/or an application (a so called "App") the user can thus simply and intuitively set the time sequence to enable the clamping device to switch. For example, the user can select a program for gradually reducing the number of cigarettes smoked in a certain period of time or select in which week days to reduce the allowed dispensation of cigarettes. Furthermore, the container can transmit information to the processing device in order to process statistics on the cigarette consumption.

According to a further aspect of the present invention, the container comprises an unlocking button configured to send an unlocking request to the logic control unit. The logic control unit is configured to switch the clamping device to the unlocked mode if the unlocking request occurs during the afore said dispensation time interval.

This way a controlled dispensation of cigarettes is obtained that prevents the smoker from picking up from the container those cigarettes that are usually smoked unwillingly, thus minimizing or at least reducing the total number of smoked cigarettes.

The processing device is preferably combined with the container, to prevent other processing devices from modifying the settings recorded by the user. The combining can be carried out for example by generating an account with a user name and a password related to an unique code (bar code, QR code, etc.) provided with the container. According to a further aspect of the present invention the container comprises sensor means to detect the opening and closing of the container. This way the logic control unit can record the openings of the container therefore computing the number of cigarettes picked up by the user and how many cigarettes remain within the container. Preferably the user can set the typology of brand or the type of cigarettes and the App computes the cost incurred by the smoker in a certain period of time (for example in the last month). Preferably, upon the expiry of the last opening related to the number of cigarettes initially inserted inside the container, the logic control unit keeps the clamping device in unlocked mode to give the possibility of inserting again a cigarette pack (or a determined number of cigarettes) into the container.

Preferably, when the logic unit of the container is connected to the processing device, the container transmits (for example at regular intervals) a log file, i.e. the log of the events recorded by the logic control unit, in which the openings of the container carried out by the user and at which moments (for example date and time) are recorded.

Preferably the container comprises means to detect the presence of a pack of cigarettes inside the container.

Further object of the present invention is a method for the controlled dispensation of cigarettes by means of a system according to any one of the afore mentioned aspects. The method comprises the steps of:

a) determining the dependence level of a user through the Fagerström test;
b) automatically setting at least one time sequence comprising at least one dispensation time interval on said processing device (15) depending on the dependence level determined in said step a);
c) transmitting, by means of said wireless communicating modules (14*a*, 14*b*), said time sequence from said processing device (15) to said logic control unit (10) of the container (1) to program the timer of said logic control unit (10);
d) switching the clamping device (8) to the unlocked mode upon receiving an unlocking request.

Advantageously, the method further comprises the step of e) recording the openings of said container which are carried out during at least one detection time interval. Preferably, step a) is carried out at least partially through an interface of the processing device. Part of the answers of the Fagerström test are automatically obtained by the processing device depending on the openings recorded during a first detection time interval of step e).

Advantageously, step b) is modified according to the openings recorded during at least one second detection time interval of the step e).

According to a particular aspect of the present invention, the method comprises a step of f) detecting the presence and the absence of a pack of cigarettes inside the container and a step of g) determining the number of openings of the container occurred between the detection of the presence of the pack inside the container and the detection of the absence of the pack inside the container.

Preferably, the method further comprises a step of h) warning the user if the number of openings determined in step g) is lower than twenty.

BRIEF DESCRIPTION OF THE DRAWINGS

Further characteristics and advantages of the invention will be more evident from the detailed description of some preferred, but not exclusive, implementations of a container for cigarettes according to the present invention.

Such a description will be herein set forth with reference to the accompanying drawings provided for illustration purposes only and, thus without limitation, in which.

DETAILED DESCRIPTION OF EMBODIMENTS OF THE INVENTION

Figure 1B:
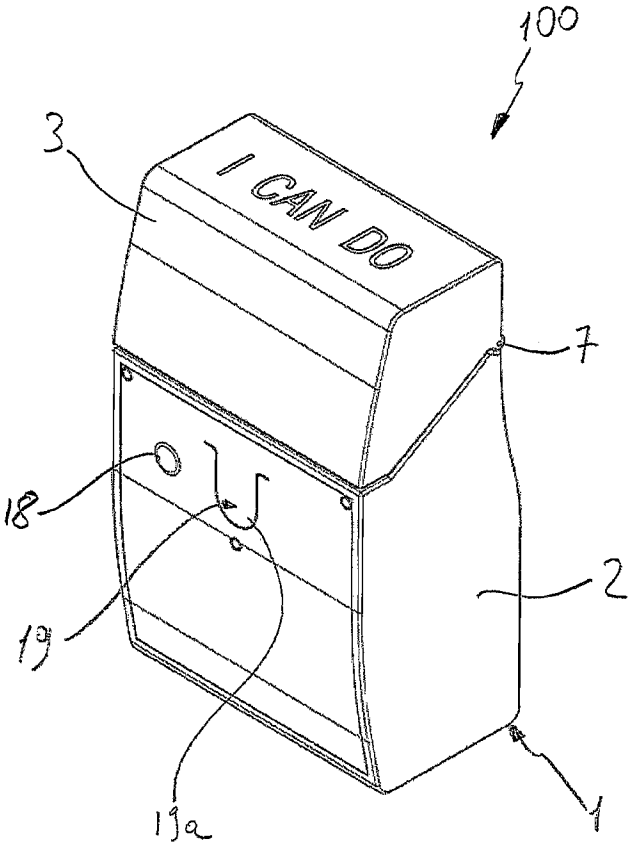
FIGS. 1A and 1B are perspective views of a container according to a particular embodiment of the system of the present invention respectively in open arrangement and in closed arrangement.
Figure 1A:
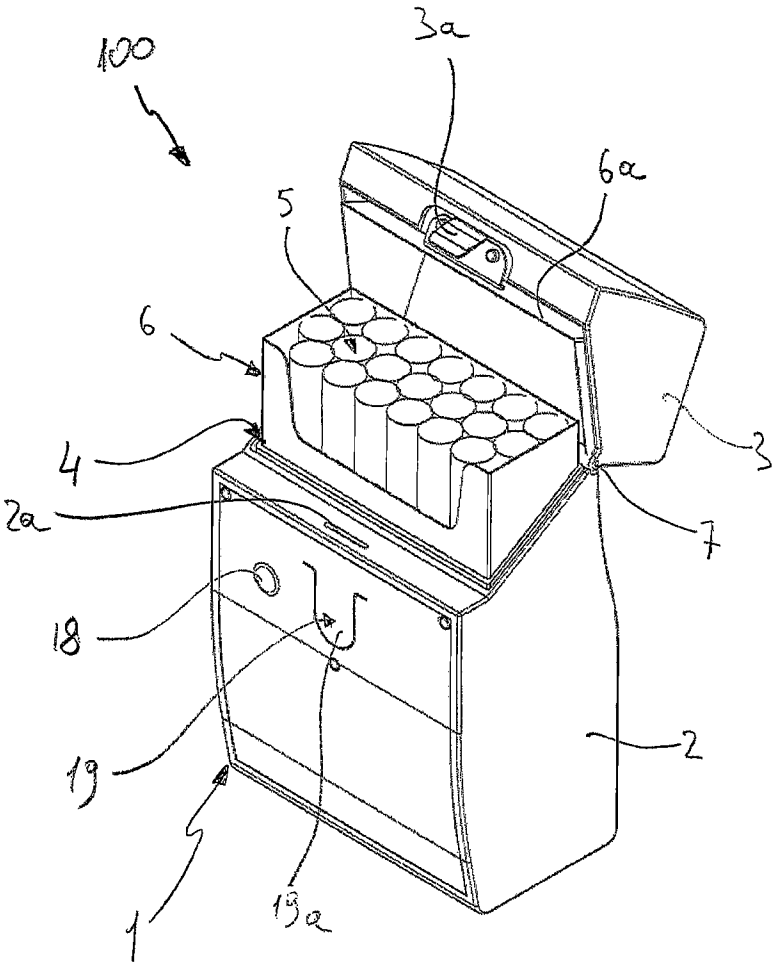

With reference to FIGS. 1A and 1B, the system 100 for the controlled dispensation of cigarettes comprises a container 1 provided with two portions 2, 3 couplable one to another to define a containing housing 4 for the cigarettes 5. The first portion 2 is adapted to contain most of the volume occupied by the cigarettes, the second portion 3 serves as a lid.

In the particular embodiment shown, the container 1 comprises two portions constrained to each other by means of a hinge 7 located on a side common to the two portions 2, 3 (for example on the long side to implement a container openable similarly to a pack of cigarettes).

The two portions 2, 3 are movable between an open arrangement (shown in FIG. 1A) and a closed arrangement (shown in FIG. 1B).

The open arrangement allows a user to access the inside of the containing housing 4 in order to pick up for example a cigarette from the container 1. The closed arrangement does not allow the user to access the inside of the containing housing wherein the cigarettes are stored. Preferably, the closed arrangement makes the container airtight, for example by means of gaskets (not shown) arranged at the interface of the portions 2, 3. Further embodiments are however provided in which the container 1 comprises a number of portions 2, 3 larger than two, or in which the at least two portions can be completely separable one from another and couplable by overlapping or interlocking them, or slidingly couplable one to another, or else hinged in different points with respect to the embodiment shown in figures (for example with a hinge arranged on the short side so that the opening of the container 1 is similar to that of the Zippo® lighters).

The couplable portions 2, 3 can define one or more containing housings 4, for example a housing 4 for the cigarettes and a housing (not shown) for a lighter, still falling in the protection scope of the present invention. Generally the container 1 comprises at least two portions 2, 3 couplable one to another to define at least one containing housing 4 for the cigarettes 5 or a pack of cigarettes 6. Preferably, the container 1 comprises a tab (not shown) arranged on the portion 3 of the container 1, by means of which the upper part of the cigarette pack 6 is restrained, in such a way that when the container 1 is brought to the open arrangement, the lid 6*a* of the pack 6 housed inside the containing housing 4 is opened by means of the tab arranged on the portion 3 of the container 1.

The open arrangement further allows the user to easily insert a certain number of cigarettes 5 or a whole cigarette pack 6 into the containing housing 4.

The container 1 can thus be made of plastic, aluminium, leather, leatherette, etc., depending on the design and the type of coupling made between the portions 2, 3. The container can be made with shapes and size different with respect to those shown in the figures, still falling in the protection scope of the present invention.

Figure 2:
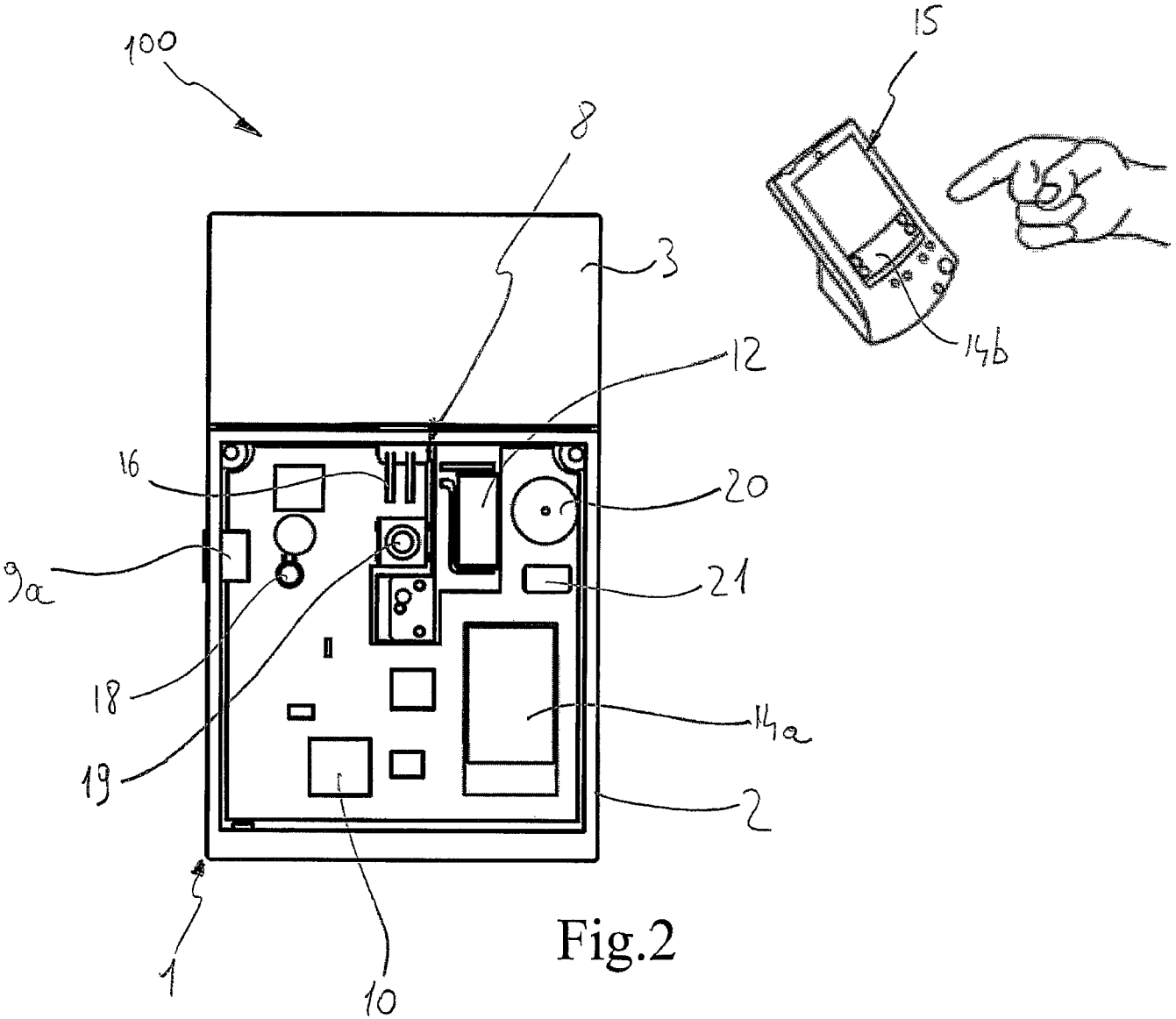
FIG. 2 is a schematic view of the main components that are in a particular embodiment of the system according to the present invention.

In FIG. 2 the container 1 of the system 100 is shown in the closed arrangement, wherein the main components with which it can be provided are schematically highlighted. In particular, the container 1 comprises a clamping device 8 switchable between a locked mode, in which the switching from the closed arrangement to the open arrangement of the container 1 is prevented, and an unlocked mode in which the switching from the closed arrangement to the open arrangement, and vice versa, is allowed.

The clamping device 8, schematically shown in FIG. 2 in the locked mode, is electrically operated by means of an electric actuator 12 configured to switch the clamping device 8 between the locked mode and the unlocked mode.

A first embodiment of the clamping device 8 will be described in greater detail in the following of the present description with reference to FIGS. 5A, 5B and 6. A second embodiment of the clamping device 8 will be described with reference to FIGS. 7A-7E. The container 1 further comprises a logic control unit 10 configured to drive the switching of the clamping device 8. In particular, the logic control unit 10 is provided with a programmable timer configured to provide at least one dispensation time interval during which the clamping device 8 is enabled to switch to the unlocked mode.

The container 1 further comprises an unlocking button 19 configured to send an unlocking request to the logic control unit 10. The logic control unit 10 is configured to switch the clamping device 8 to the unlocked mode if the unlocking request occurs during the dispensation time interval.

The system 100 further comprises a processing device 15 combined with the container 1. The container comprises a first wireless communicating module 14*a*, the processing device 15 comprises a second wireless communicating module 14*b* for transceiving data between the logic control unit 10 and the processing device 15. The timer of the logic control unit 10 is programmable by means of the processing device 15.

In other words, the timer of the logic control unit can be programmed so as to provide one or more dispensation time intervals in which the user is allowed to open the container upon sending an unlocking request. Thus, if the unlocking request is sent during an allowed dispensation time interval, the logic control unit 10 will switch the clamping device 8 to the unlocked mode, otherwise the clamping device 8 will not allow the user to open the container 1 remaining in the unlocked mode.

As it will be described in greater detail in the following of the present description, the time sequence is automatically set by the processing device 15 depending upon the user dependence level determined through the Fagerström test.

An established time sequence set on the processing device 15 is transmitted to the logic control unit 10 by means of the wireless communicating modules 14*a*, 14*b*. The set time sequence comprises time intervals in which the unlocking of the clamping device is allowed and time intervals in which the unlocking is not allowed. The logic control unit 10 is therefore provided with a timer (for example a synchronization circuit provided with a quartz oscillator) and a counter by means of which the elapsed time is taken. The clamping device 8 will be enabled to switch to the unlock mode during one or more dispensation time intervals programmed and stored by the logic control unit 10.

The wireless communicating modules 14*a*, 14*b* are preferably of the Bluetooth type, more preferably BLE (Bluetooth Low Energy).

Figure 3B:
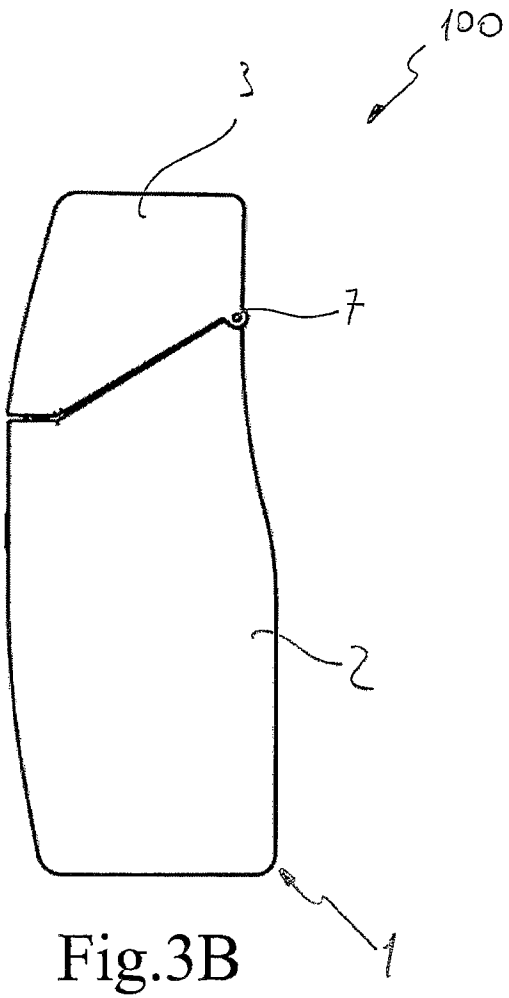
FIGS. 3A and 3B are side views of a container according to a particular embodiment of the system of the present invention, respectively in open arrangement and in closed arrangement.

The container 1 further comprises means for power supplying 9 all the electric components of the container 1 that are preferably housed inside a containing housing 17 preferably made inside one of the portions 2, 3 of the container 1. For example in the embodiment shown in FIGS. 3A and 3B, the containing housing 17 for the electric parts is made inside the portion 2 of the container 1.

Preferably, as shown in FIGS. 1A and 1B, the portion 2 of the container 1 comprises a flexible fin 19*a* (made for example by means of a substantially C-shaped notch at the button 19) arranged to cover the unlocking button 19, so that the outer surface of the container 1 is substantially smooth. This way, unwanted presses of the button 19 can be avoided, for example when the container 1 is put inside the pocket by the user.

The power supplying means 9 comprise at least one, preferably rechargeable battery, and possibly an inlet 9*a* preferably with USB (Universal Serial Bus) port with mini A or mini B connectors for the electric power supply from the mains and/or battery recharge. An embodiment is however provided, wherein power supply means 9 comprise batteries of the replaceable "button" type (CR, SR, A, AC, PR).

Figure 3A:
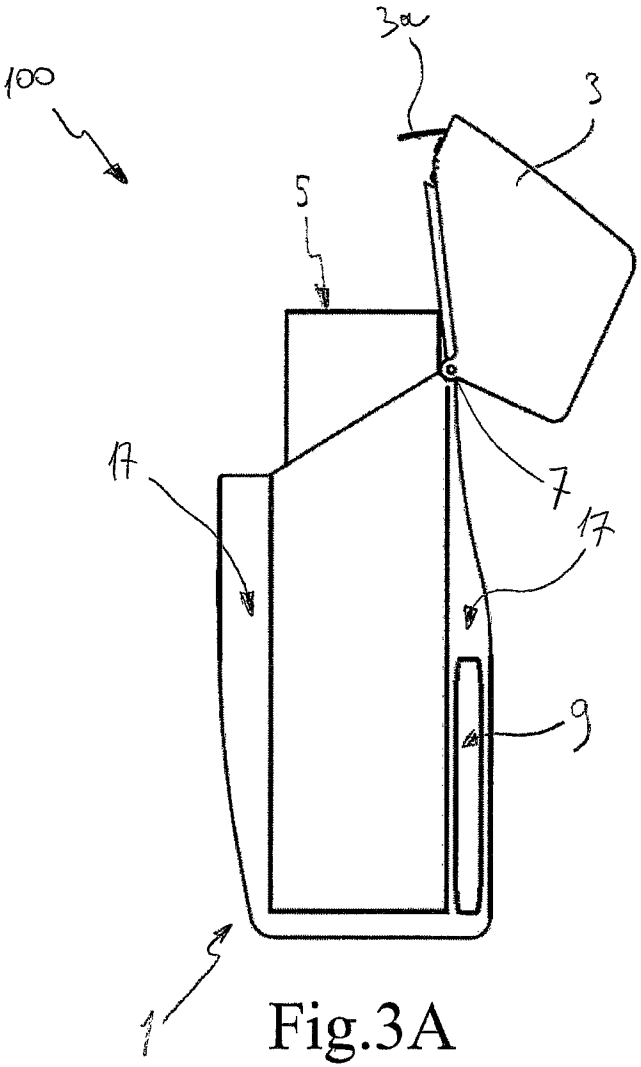

For example, in the embodiment shown in FIG. 3A, the rear part of the portion 2 of the container 1 is preferably provided with a housing 17 in which a battery 9 is accommodated.

In case the container 1 is provided with the afore said inlet 9*a* for the power supply, the logic control unit 10 of the container 1 can be connected to the processing device 15 also by means of a USB cable.

The user can program the timer of the logic control unit 10 by means of the afore said processing device 15 that can be a PC, a smart phone, a tablet, etc., In particular, by means of a program and/or an application (a so called "App"), the user can simply and intuitively set the time sequence to enable the clamping device 8 to switch.

The sequence is therefore sent by the communication module 14*b* of the processing device 15 to the communicating module 14*a* of the container 1 and recorded by the logic control unit 10 of the container 1.

By way of example, the time sequence set can provide that the clamping device 8 is enabled to switch to the unlocked mode a certain number of times within a certain time period (one hour, one day, one week, one month, etc.). Enabling the switching of the clamping device to the unlock mode can be programmed in certain times and/or days, for example by means of an electronic calendar provided by the App.

Once a determined time sequence has been set, the processing device 15 processes the information and generates a code containing the particular time sequence, the latter being time synchronized with date and time of the processing device 15. The sequence is then sent to the communicating module 14*a* and stored by the logic control unit 10.

Further embodiments are provided in which the user can select an established program for gradually reducing the number of cigarettes smoked in a determined period of time or select in which week days to increase the locking rate of the clamping device. Alternatively, the user can set that the allowed dispensation time interval starts after an established period of time from the last dispensing carried out (i.e. upon the opening the container). In this last case, the container 1 preferably comprises sensor means 16 to detect the opening and closing of the container 1. In the embodiment shown in figures, the means 16 comprise a sensor arranged on the portion 2 to detect the presence of the portion 3 when the container is in closed arrangement.

Figure 4A:
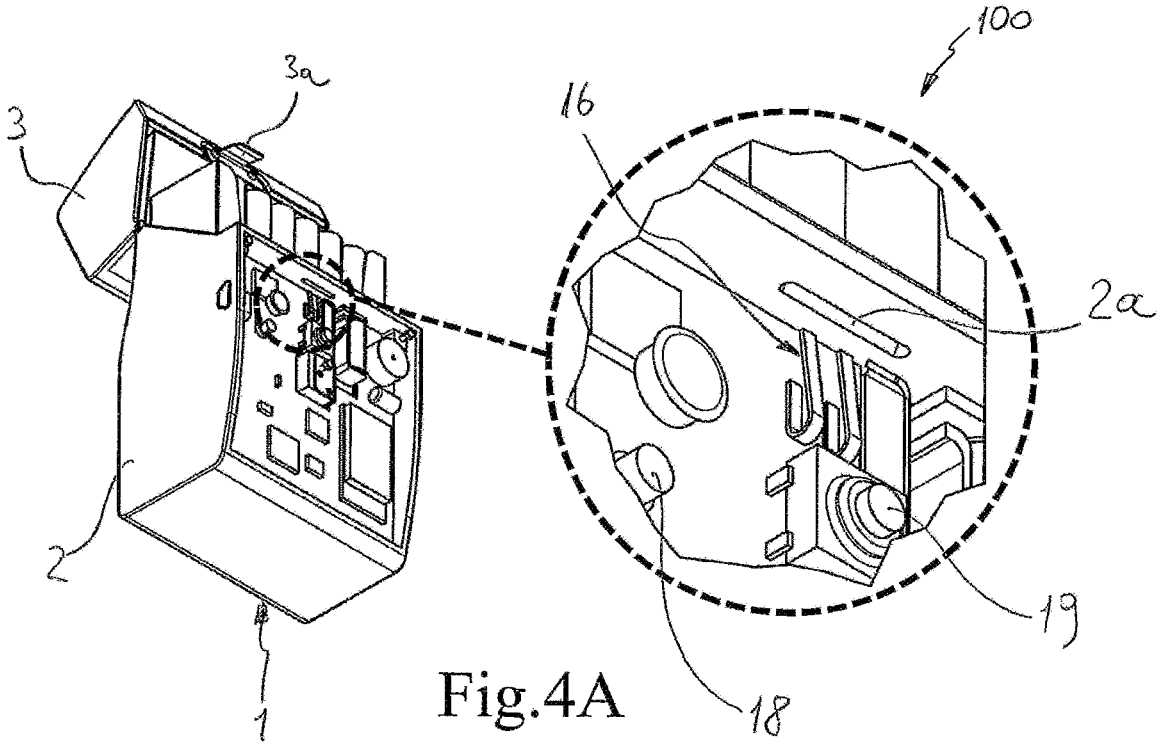
FIGS. 4A and 4B show a particular embodiment of the clamping device of the system according to the present invention when the container is respectively in open arrangement and in closed arrangement.
Figure 4B:
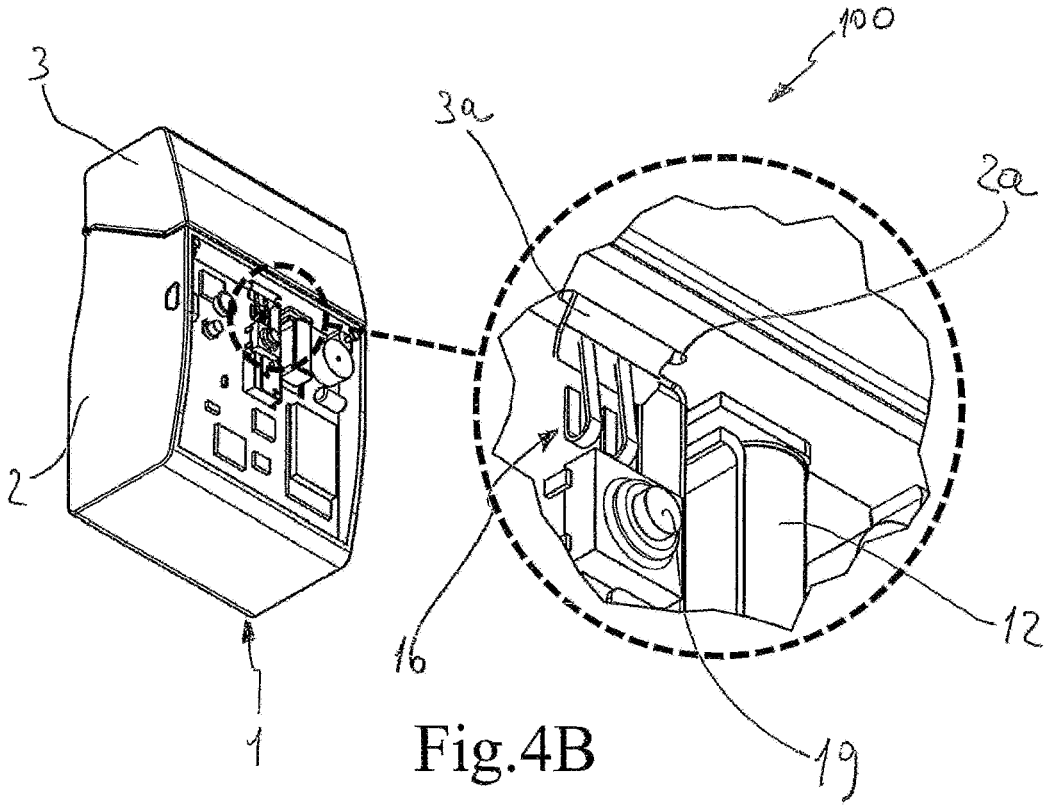

With reference to FIGS. 4A and 4B, the portion 3 of the container 1 comprises a fin 3*a* configured to be inserted inside a slot 2*a* obtained on the portion 2 of the container 1, when the container 1 is in the closed arrangement. In FIGS. 4A and 4B the container 1 is shown with the front part of the portion 2 uncovered to show the electronic components inside the housing 17. In this embodiment, the means 16 comprise a stop sensor arranged under the slot 2*a* and shaped to accommodate the fin 3*a* of the portion 3.

Further embodiments can however provide that the means 16 comprise a micro-switch arranged between the portion 2 and the portion 3 of the container such that when the container is closed the micro-switch is pressed, vice versa when the container is open, the micro-switch is released. The means to determine the opening and closing of the container can comprise photocells, or proximity sensors and similar means known per se in the art for determining the opening and closing of a container. The means 16 are connected to the logic control unit 10 to determine the opening and closing of the container 1.

This way the logic control unit can advantageously count the number of openings of the container therefore computing the number of cigarettes picked up by the user and how many cigarettes remain within the container. Preferably, upon the expiry of the last opening related to the number of cigarettes initially inserted inside the container, the logic control unit keeps the clamping device in unlocked mode to give the possibility of inserting again a cigarette pack (or a determined number of cigarettes) into the container. Preferably, the container 1 comprises means (not shown) to detect the presence of a cigarette pack 6 inside the container 1 (for example at least one proximity sensor on the bottom of the container).

This way, the number of openings of the container 1, occurred between the detection of the presence of the pack 6 inside the container 1 and the detection of the absence of the pack 6 inside the container 1, can be determined. If such a number of openings is lower than twenty, the user is warned by means of a message on the processing device 15 and/or by means of an acoustic signal produced by a speaker of the processing device 15 and/or a speaker 20 provided on the container 1.

The container 1 can transmit information to the processing device by means of the same communicating module 14*a* in order to process statistics on the cigarette consumption. Preferably the user can set the typology of brand or the type of cigarettes and the App computes the cost incurred by the smoker in a certain period of time (for example in the last month).

When the user changes the time sequence of switching the clamping device in order to reduce the number of smoked cigarettes, the logic control unit makes the changes immediately effective and preferably the App shows the user a "POSITIVE" message, for example: "Good! You are changing your smoking habits, this is good for your health!". Vice versa, if the change is carried out in order to increase the number of smoked cigarettes (for example by reducing the length and/or the rate of the locked mode of the clamping device), the logic control unit makes such a change effective with a time delay comprised between 12 and 24 hours. In this last case the App preferably shows a "NEGATIVE" message, for example: "Attention! You are changing you smoking habits negatively for your health, are you sure you want to change them? Your change request will be recorded in the next 12-24 hours!".

Further embodiments can provide that the message shown to the user upon changing the time sequence of switching the clamping device 8 is a voice message emitted by a speaker of the processing device 15 and/or a speaker 20 provided on the container 1.

The App can be able to trace the container 1 by means of the data transmission between the communicating modules 14*a* and 14*b* of the container 1 and the processing device 15 respectively, until the container 1 is in the connection range. For example, in case the wireless communicating modules 14*a*, 14*b* are of Bluetooth type, the logic control unit 10 can generate an acoustic signal by means of the speaker 20.

Further embodiments can provide that the processing device 15 emits an intermittent acoustic signal (for example a "beep") whose intermittence frequency varies depending on the power of the signal received by means of the module 14*b* and sent by the communicating module 14*a* of the container 1 (as a kind of metal detector).

The container 1 comprises at least one LED 18 connected to the logic control unit to show the locking and/or unlocking of the clamping device 8. Further embodiments can provide further LEDs 18 to show the battery charge status, if the battery is in charge, full charge, etc. An alternative embodiment can further provide that, instead of the LEDs 18 or in addition to the LEDs 18, the container is provided with a liquid crystal display, to show further information such as for example a countdown to reach an allowed dispensation time interval.

In a preferred embodiment, the unlocking button 19 is further configured to send an anti-panic unlocking control to the logic control unit 10. In an alternative embodiment, the anti-panic unlocking control can be sent through the processing device 15 and/or through the unlocking button 19.

The anti-panic unlocking button allows the user to drive the unlocking of the clamping device independently of the unlocking time sequence set on the timer of the logic control unit 10. The logic control unit 10 is therefore configured to switch the clamping device 8 to the unlocked mode upon receiving the anti-panic unlocking control. The anti-panic unlocking control can be acknowledged for example by the logic control unit 10 as a rapid to succession of presses on the unlocking button 19 (for example two presses in five seconds, or five presses in one second) or a prolonged press on the unlocking button (for example a press with length longer than or equal to five seconds, for example 10 seconds). A preferred embodiment can provide that the anti-panic unlocking control and/or the unlocking request can be customized by the user by setting a sort of password made up of a particular succession of presses of the unlocking button having determined frequency and/or duration.

Preferably, the container 1 comprises an impact sensor 21 (for example an accelerometer) able to detect attempts of tampering the container by the user or outsiders. The impact sensor 21 is thus connected with the logic control unit 10 transmitting by means of the communicating module 14*a* a log file wherein all the events detected of the logic control unit 10 (such as for example the openings in the allowed dispensation time interval, the openings upon requesting anti-panic unlocking, the detected impacts, etc.) are recorded. All the information detected by the logic control unit are sent to the processing device 15, that by means of a local or preferably remote processing program, adapts the unlocking time sequence to the number of openings of the container carried out by the user.

Some embodiments can further provide that the container 1 comprises means to deactivate the first wireless communicating module 14*a* independently of the logic control unit 10. This way the container 1 can still operate without emitting electromagnetic waves. Such a characteristic is advantageous in case the so called "flight mode" has to be activated for the container 1, i.e. a mode by which the logic control unit 10 is active and the first wireless communicating module 14*a* is deactivated. For example, the means to deactivate the first wireless communicating module 14*a* can comprise a switch (preferably accessible to the user from the outer surface of the container) with which the electric connection between the first wireless communicating module and the power supply can be selectively switched.

In brief, by means of the system 100 a method of dispensing cigarettes 5 in a controlled way can be effected, comprising the steps of:

a) determining the dependence level of a user through the Fagerström test;

b) automatically setting at least one time sequence comprising at least one dispensation time interval on said processing device (15);

c) transmitting, by means of said wireless communicating modules (14*a*, 14*b*), said time sequence from said processing device (15) to said logic control unit (10) of the container (1) to program the timer of said logic control unit (10) depending on the dependence level determined in step a);

d) switching the clamping device (8) to the unlocked mode upon receiving an unlocking request;

The step d) is carried out if the unlocking request occurs during the dispensation time interval.

Furthermore, the method can comprise the step of e) recording the openings of said container 1 which are carried out during at least one established detection time interval (for example in the last twenty four hours).

The Fagerström test can be carried out at least in part through an interface of the processing device 15.

Preferably, part of the answers of the Fagerström test are automatically obtained by the processing device 15 depending on the openings recorded during a first detection time interval of step e). For example, firstly the container is kept unlocked for a first detection interval in order to record the openings of the container so as to determine the smoker habits and to obtain part of the answers of the Fagerström test.

In a preferred embodiment, the processing device can initially request the user to input data relating to his/her own habits (number of daily smoked cigarettes, times and/or days of high consumption, etc.). In particular, through an interface of the processing device 15, the user can easily answer to a multiple choice point questionnaire in order to compute the user dependence level. The questionnaire corresponds to the Fagerström test, which is a standard tool to evaluate the intensity of the physical dependence on nicotine. The dependence intensity is evaluated in user dependence levels. Each dependence level corresponds to an established range of numerical values. The sum of the answer points is between zero (slight dependence) and ten (very strong dependence). In such embodiments, the time sequence can be automatically set by the processing device 15 depending on these collected data.

The time sequence is set such that the number of cigarettes smoked by the user is gradually reduced depending on the user dependence level. In particular, after a dependence level through the Fagerström test is obtained, the time sequence is set to remove an established number of cigarettes per day according to a particular reduction program.

Preferentially, the reduction program is set depending on the number of cigarettes the smoker smoked on average in one day (obtained for example by the record of the container openings, and the dependence level obtained by the Fagerström test).

For example, in case the number of cigarettes smoked on average in one day by the smoker is lower than or equal to 5, it results that:

with a dependence level lower than or equal to five, the reduction program provides for removing 1 cigarette per day every week until complete cessation;

with a dependence level higher than five, the reduction program provides for removing 1 cigarette per day every 2 weeks until complete cessation.

In case the number of cigarettes smoked on average in one day by the smoker is between 6 and 8, it results that:

with a dependence level lower than or equal to five, the reduction program provides for removing 2 cigarettes per day every 2 weeks until complete cessation;

with a dependence level higher than five, the reduction program provides for removing 2 cigarettes per day every 3 weeks until complete cessation.

In case the number of cigarettes smoked on average in one day by the smoker is between 9 and 10, it results that:

with a dependence level lower than or equal to five, the reduction program provides for removing 2 cigarettes per day every week until complete cessation;

with a dependence level higher than five, the reduction program provides for removing 2 cigarettes per day every 2 weeks until complete cessation.

In case the number of cigarettes smoked on average in one day by the smoker is between 11 and 15, it results that:

with a dependence level lower than or equal to five, the reduction program provides for removing 2 cigarettes per day every week until complete cessation;

with a dependence level higher than five, the reduction program provides for removing 2 cigarettes per day every week for the first 3 weeks, then removing 2 cigarettes per day every 2 weeks, until complete cessation.

In case the number of cigarettes smoked on average in one day by the smoker is between 16 and 20, it results that:

with a dependence level lower than or equal to five, the reduction program provides for removing 3 cigarettes per day per week until complete cessation;

with a dependence level higher than five, the reduction program provides for removing 3 cigarettes per day per week for the first 3 weeks, then removing 2 cigarettes per day per week, until complete cessation.

In case the number of cigarettes smoked on average in one day by the smoker is between 21 and 25, it results that:

with a dependence level lower than or equal to five, the reduction program provides for removing 3 cigarettes per day per week until complete cessation;

with a dependence level higher than five, the reduction program provides for removing 3 cigarettes per day per week for the first 4 weeks, then removing 2 cigarettes per day per week, until complete cessation.

In case the number of cigarettes smoked on average in one day by the smoker is between 26 and 30, the reduction program provides for removing 4 cigarettes per day per week for the first 3 weeks, then removing 3 cigarettes per week, until complete cessation.

In case the number of cigarettes smoked on average in one day by the smoker is between 31 and 35, the reduction program provides for removing 5 cigarettes per day per week for the first 3 weeks, then removing 3 cigarettes per week, until complete cessation.

In case the number of cigarettes smoked on average in one day by the smoker is between 36 and 40, the reduction program provides for removing 5 cigarettes per day per week for the first 5 weeks, then removing 3 cigarettes per week, until complete cessation.

In case the number of cigarettes smoked on average in one day by the smoker is between 41 and 45, the reduction program provides for removing 5 cigarettes per day per week for the first 6 weeks, then removing 3 cigarettes per week, until complete cessation.

In case the number of cigarettes smoked on average in one day by the smoker is between 46 and 49, the reduction program provides for removing 5 cigarettes per day per week for the first 6 weeks, then removing 4 cigarettes per week, until complete cessation.

In case the number of cigarettes smoked on average in one day by the smoker is between 50 and 54, the reduction program provides for removing 10 cigarettes per day per week for the first 2 weeks, then removing 5 cigarettes per week for two other weeks, then removing 4 cigarettes per week until complete cessation.

In case the number of cigarettes smoked on average in one day by the smoker is between 55 and 60, the reduction program provides for removing 10 cigarettes per day per week for the first 3 weeks, then removing 5 cigarettes per week for two other weeks, then removing 4 cigarettes per week until complete cessation.

In case the number of cigarettes smoked on average in one day by the smoker is larger than 61, the reduction program provides for removing 10 cigarettes per day for the first 4 weeks, then removing 5 cigarettes per day per week for the 2 subsequent weeks, then removing 4 cigarettes per day until complete cessation.

Preferably, the time sequence set in step b) is changed (for example by means of an App) depending on the openings recorded in one or more detection time intervals (for example every twenty four hours or every week) of step e).

For example, if the user carried out a number of openings small with respect to the duration of the dispensation time interval, the time sequence will be adapted so as to reduce the duration of the dispensation time interval and/or the number of dispensation time intervals and/or the number of allowed openings of the container during each dispensation time interval. In this case, sending POSITIVE messages encouraging the user to prosecute the program for reducing the smoking vice can be also provided. In case the user sent the anti-panic unlocking control, then the time sequence will be adapted by increasing the number of allowed openings of the container during each dispensation time interval and/or increasing the duration and/or the number of dispensation time intervals, preferably by shifting them temporally at the moment (week day, time) the anti-panic unlocking control has been used by the user. In the latter case, sending NEGATIVE messages can be provided in order to tempt the user to reduce the number of smoked cigarettes.

The method can comprise a step of f) detecting the presence and the absence of a pack of cigarettes inside the container and a step of g) determining the number of the container openings occurred between the detection of the presence of the pack 6 inside the container and the detection of the absence of the pack 6 inside the container 1.

Preferably, the method comprises a step of h) warning the user if the number of openings determined in step g) is lower than twenty. The user can be warned for example by means of the processing device 15.

Preferably, the method can provide the step of sharing on the Net the performance of the program for reducing the smoking vice. In this case the App (with the user consent) is able to share on social networks (for example Facebook®) messages related to the reduction and the goals reached by the user during the program for reducing the smoking vice carried out by means of the system according to the present invention.

Figure 5B:
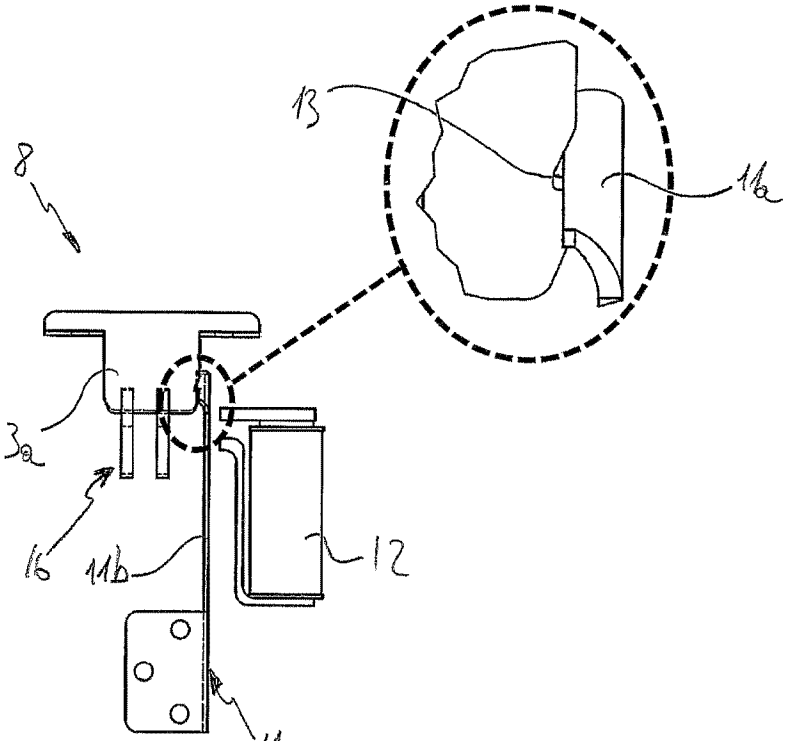
FIGS. 5A and 5B show a particular embodiment of the locking element of the system according to the present invention when the container is respectively in open arrangement and in closed arrangement.
Figure 5A:
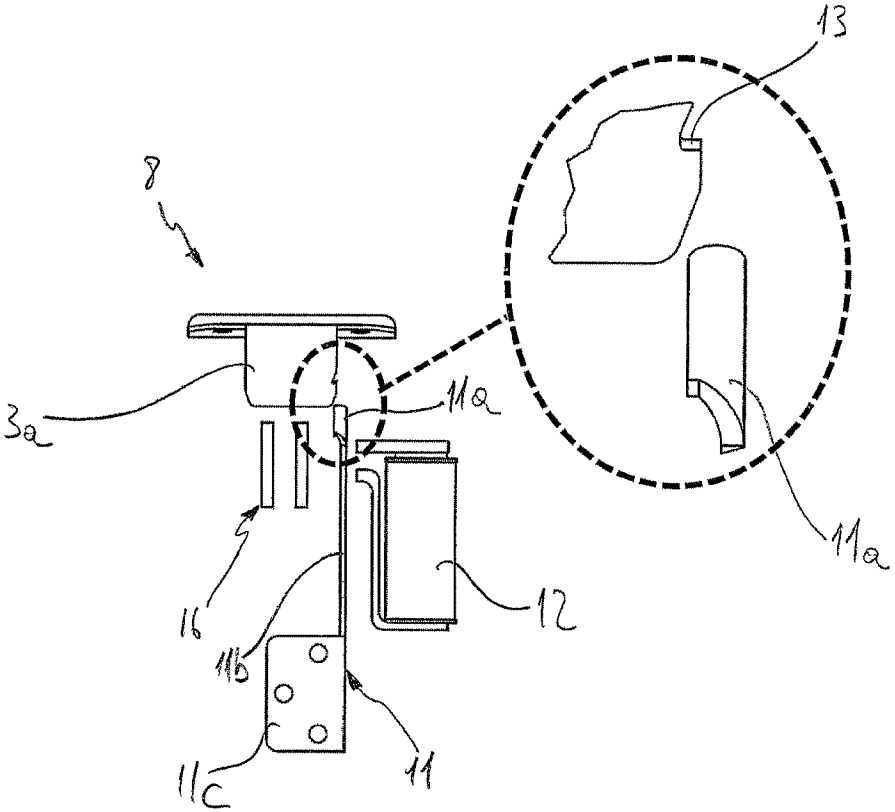
Figure 6:
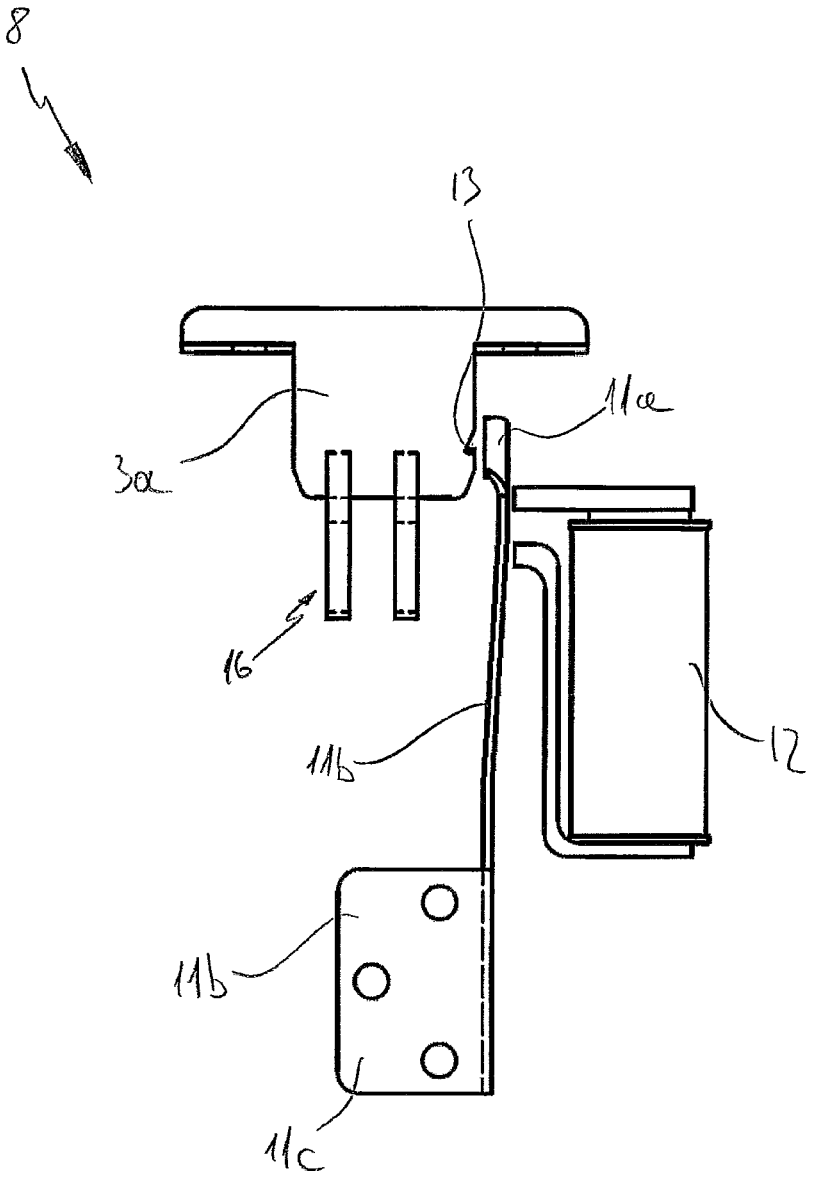
FIG. 6 shows a particular embodiment of the clamping device in unlocked mode.

With reference to FIGS. 5A, 5B and 6, a particular embodiment of the clamping device 8 of the system 100 according to the present invention is described in detail.

Preferably, the clamping device 8 comprises at least one locking element 11 arranged on the portion 2 of the container 1.

The locking device comprises an ending portion 11*a* adapted to be engaged in a respective seat 13 preferably arranged on the fin 3*a* of the portion 3 of container 1. With reference to FIG. 5B, when the locking element 11 engages the seat 13, the locked mode is implemented. In this mode, the ending part 11*a* of the locking element 11 does not allow the fin 3*a* to be lifted off.

The clamping device 8 preferably comprises elastic countering means 11*b* to keep the locking element 11 engaged in the seat 13. In the embodiment shown in FIGS. 5A, 5B and 6, the locking element comprises a base 11*c* fastened to the portion 2 of the container 1 and a flexible rod 11*b* connecting the ending part 11*a* of the locking element with the base 11*c*.

When the container 1 is brought in closed arrangement (from the arrangement shown in FIG. 5A to the arrangement shown in FIG. 5B), the flexible rod 11*c* is initially deformed by flexing to allow the fin 3*a* to reach the sensor stop 16. When the container 1 is brought in closed arrangement (FIG. 5B), the ending part 11*a* of the locking element 11 is engaged in the seat 13 and the rod elastically returns to a not deformed arrangement mechanically maintaining the locking element 11 in the seat 13 by the elastic thrust of the flexible rod 11*c*.

The clamping device 8 further comprises an electric actuator 12 driven by the logic control unit 10 in order to move the locking element with respect to the seat 13. This way the clamping device can be switched between the locked mode and the unlocked mode. Preferably, the electric actuator 12 comprises an electromagnet configured to attract to itself the locking element 11 so that to maintain the clamping device in the unlocked mode.

With reference to FIG. 6, when the electromagnet 12 is activated, is attracts to itself the ending portion 11*a* of the locking element, the ending portion being at least in part made with ferromagnetic material. The magnetic attraction allows the locking element to be displaced with respect to the seat 13 by overcoming the springback of the flexible rod 11*c* thus achieving the unlocked mode of the clamping device 8.

Further embodiments can however provide that the electric actuator 12 comprises for example a piezoelectric actuator or further electrically actuated means, in order to move the locking element with respect to the seat 13.

With reference to FIGS. 7A-7E, a further embodiment of the clamping device 8 of the system 100 according to the present invention is described in detail. In this embodiment, the fin 3*a* of the portion 3 has a forked shape adapted to be inserted inside a slot 24 of a locking element 11 arranged on the portion 2 of the container 1. The locking element 11 comprises two portions 11*a*, 11*b* sliding along a direction perpendicular with respect to the insertion direction of the fin 3*a* inside the slot 24.

The portion 11*a* has a slot 24*a*, the portion 11*b* has a slot 24*b*, which are arranged so that to form a slot 24 whose width varies depending on the mutual position of the portions 11*a*, 11*b* of the locking element 11. In particular, the portion 11*a* of the locking element is adapted to be engaged in a seat 13 made on the fin 3*a* of the portion 3 of the container 1.

Figure 7A:
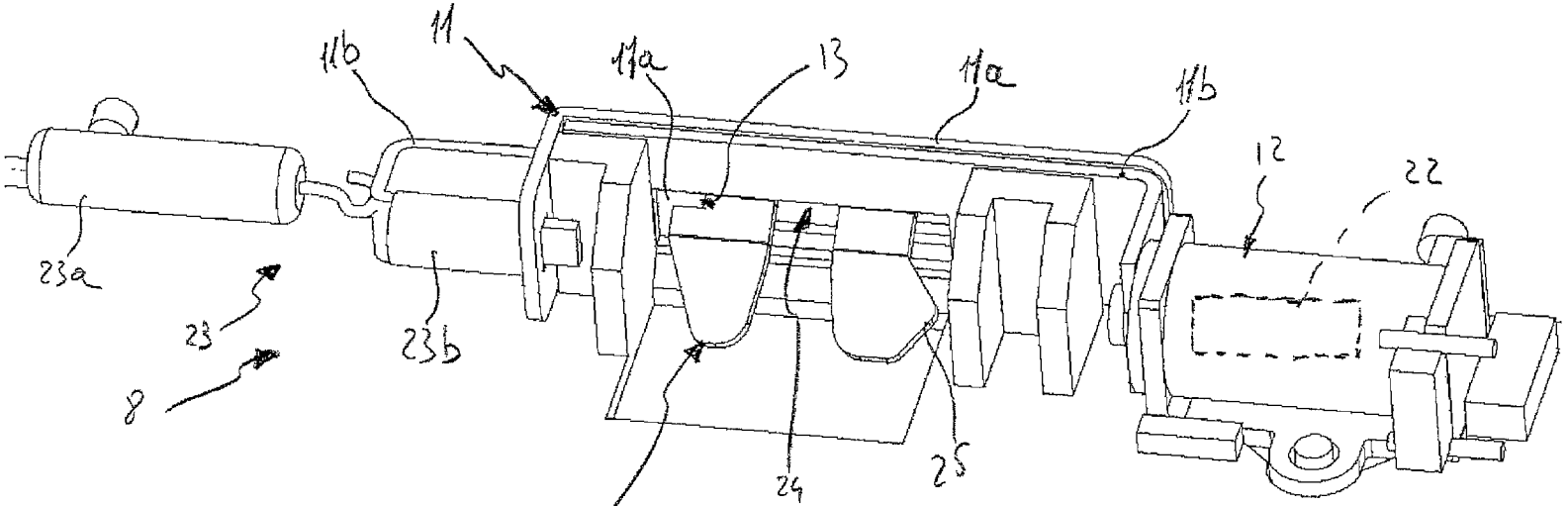
FIGS. 7A-7E show a particular embodiment of the clamping device of the system according to the present invention, in some working steps.

With reference to FIG. 7A, the fin 3*a* has a seat 13 (for example a notch) adapted to accommodate the portion 11*a* of the locking element 11 so that to prevent the escape of the fin 3*a* from the slot 24.

The clamping device 8 comprises a permanent magnet 22 (symbolically shown with a dotted rectangle) arranged to exert a magnetic force on the locking element 11, and in particular on the portion 11*b* of the locking element 11, so that to keep the clamping device 8 in locked mode when the locking element 11 is engaged in the seat 13 (as shown in FIG. 7A).

An end of the portion 11*b* is subjected to an attractive magnetic force exerted by the permanent magnet 22, the other end of the portion 11*b* is subjected to an elastic force opposed to the afore said magnetic force, exerted by a spring 23*a*. The portion 11*b* of the locking element 11, when the clamping device 8 is in locked mode, is subjected to an attractive magnetic force exerted by the permanent magnet and greater than the elastic force exerted by the spring.

Figure 7B:
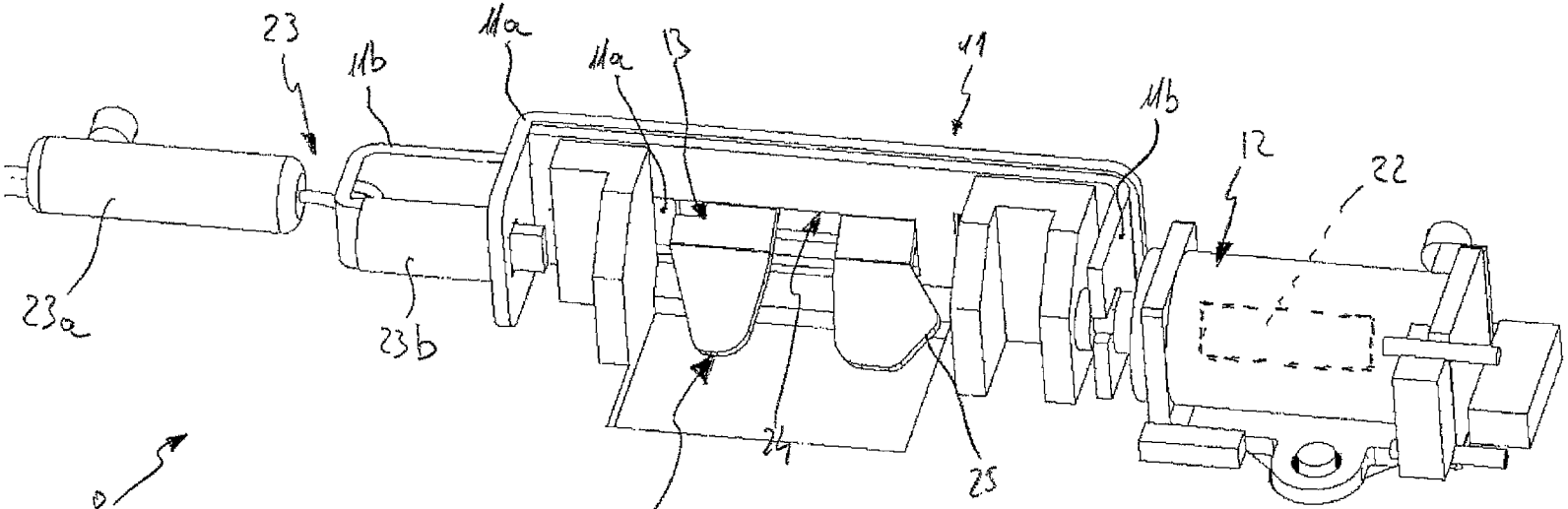

The clamping device 8 comprises an electromagnet 12 arranged to produce a magnetic field adapted to counteract the magnetic field produced by said permanent magnet 22. For example, the electromagnet 12 can be made by winding a coil around the permanent magnet 22 around the magnetic axis (North-South) of the permanent magnet 22. When the electromagnet is activated, the elastic force exerted by the spring 23*a* becomes higher than the resulting magnetic force acting from the permanent magnet 22 and the electromagnet 22. This way the portion 11*b* is shifted together with the portion 11*a* of the locking element that is disengaged from the seat 13 of the fin 3*a* (as shown in FIG. 7B). A reduced amount of electric energy (a short pulse) is therefore enough to switch the clamping device from the locked mode to the unlocked mode.

In the arrangement shown in FIG. 7B, the elastic force exerted by the spring on the portion 11*b* of the locking element 11 is larger than the magnetic force exerted by the permanent magnet since the portion 11*b* moving away from the permanent magnet will be subjected to a lower magnetic force decreasing with the distance from the permanent magnet 22.

Figure 7C:
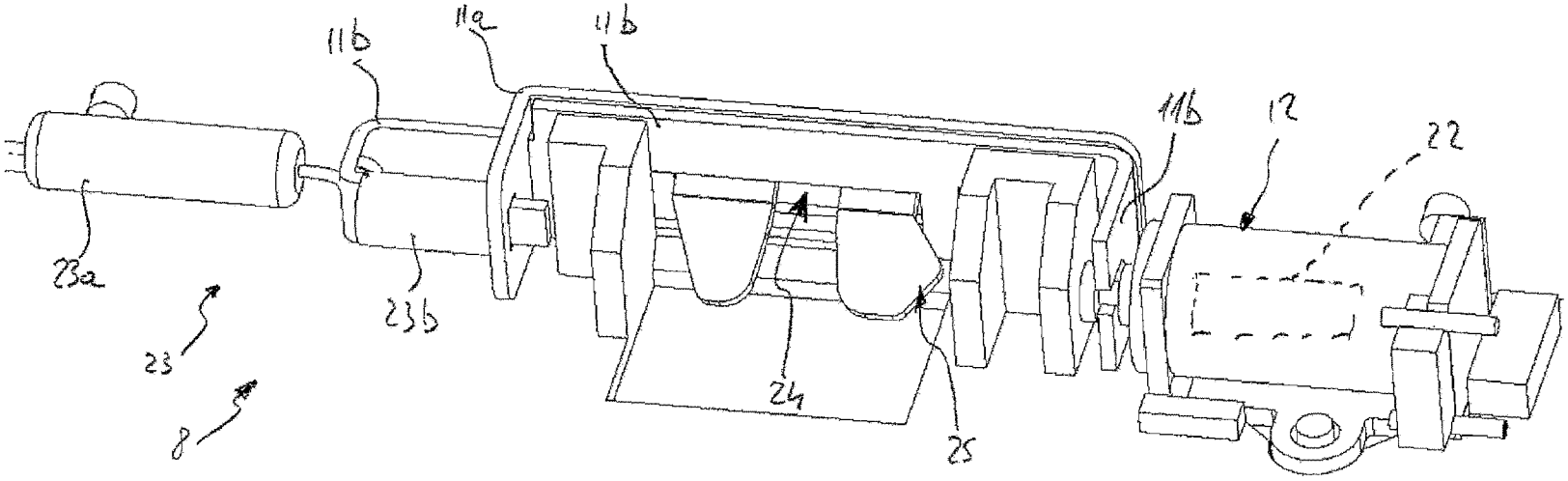
Figure 7D:
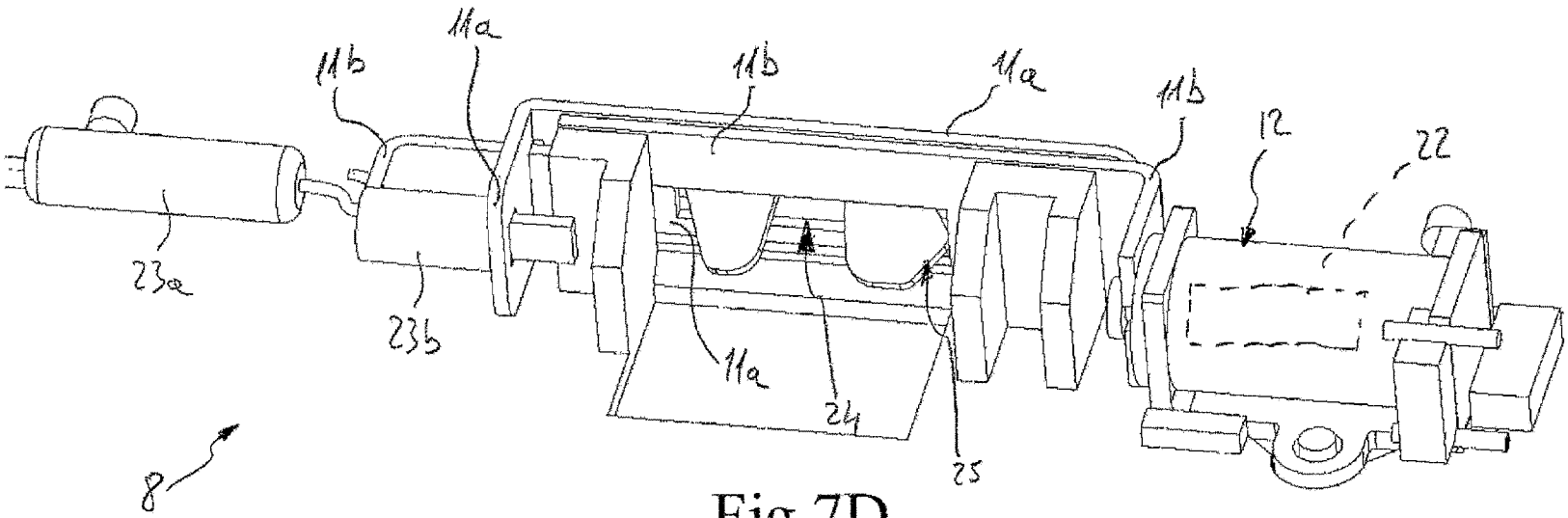
Figure 7E:
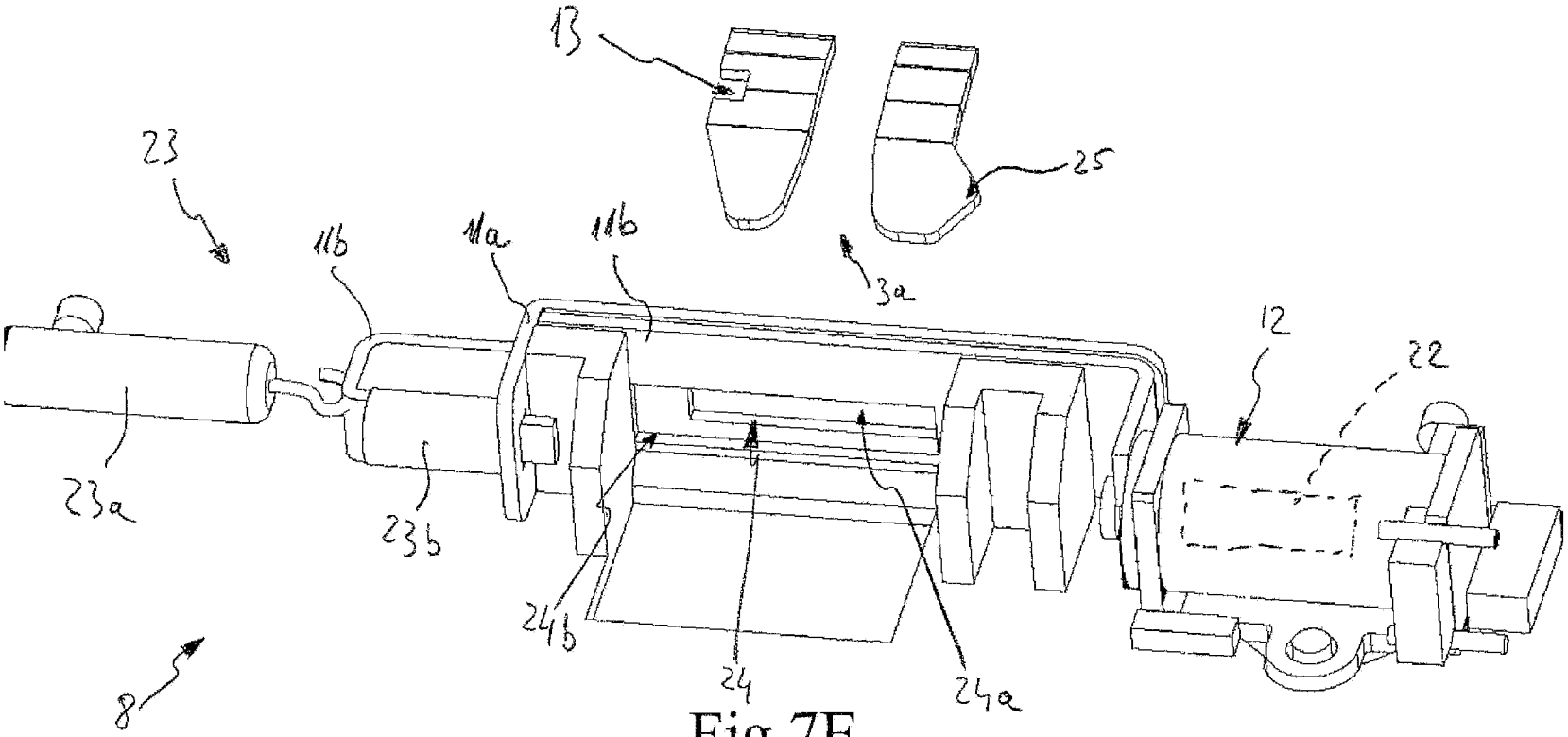

With reference to FIG. 7C, the fin 3*a* can be brought outside of the slot 24 since the seat 13 is not occupied by the portion 11*a* of the locking element 11*b*. With reference to FIG. 7D, the fin 3*a* is provided with a cam portion 25 adapted to displace the portion 11*b* of the locking element towards the permanent magnet 22 during the escape of the fin 3*a* from the slot 24. During such an operation, a second spring 23*b* arranged between the portion 11*a* and the portion 11*b* of the locking element 11 is compressed.

When the fin 3*a* is completely released from the slot 24, the second expanding spring 23*b* displaces the portion 11*a* of the locking element with respect to the portion 11*b* (that is restrained by the permanent magnet) so that to reduce the width of the slot 24. In this arrangement shown in FIG. 7E, the locking element 11 is in the same arrangement shown in FIG. 7A.

When the fin 3*a* is inserted again inside the slot 24, the cam portion 25 acts on the portion 11*a* that is displaced so that to increase the width of the slot 24, to allow the fin 3*a* to be passed through the slot 24. When the seat 13 of the fin is aligned to the portion 11*a* of the locking element (as shown in FIG. 7B), the elastic force of the second spring 23*b* displaces the portion 11*a* with respect to the portion 11*b* thus bringing the portion 11*a* back inside the seat 13 of the fin 3*a* and bringing back the clamping device 8 to locked mode (as shown in FIG. 7A).

The invention claimed is:

1. System for the controlled dispensation of cigarettes, comprising a container of the type provided with at least two portions couplable one to another to define at least one containing housing to contain the cigarettes or a cigarette pack, said at least two portions being movable between an open arrangement in which said containing housing can be accessed from the outside of the container, and a closed arrangement in which said containing housing cannot be accessed from the outside of the container, said container comprising a clamping device switchable between a locked mode, in which the switching from said closed arrangement to said open arrangement of said container is not allowed, and an unlocked mode in which the switching between said closed arrangement to said open arrangement of said container and vice versa, is allowed, said container further comprising a logic control unit configured to drive the switching of the clamping device, said logic control unit being provided with a programmable timer configured to provide at least one dispensation time interval during which said clamping device is enabled to switch to said unlocked mode, said system comprising a processing device combined with said container, said processing device being configured for determining the dependence level of a user through the Fagerström test, said container comprising a first wireless communicating module, said processing device comprising a second wireless communicating module for transceiving data between said logic control unit and said processing device, said timer being programmable as a function of said dependence level determined through the Fagerström test, and in that said container comprises an unlocking button configured to send an unlocking request to said logic control unit, said logic control unit being configured to switch said clamping device to said unlocked mode if said unlocking request occurs during said at least one dispensation time interval.

2. System according to claim 1, wherein said container comprises means to deactivate said first wireless communicating module independently from said logic control unit.

3. System according to claim 1, wherein said container comprises at least one LED to show when the clamping device is locked and/or unlocked.

4. System according to claim 1, wherein said unlocking button is further configured to send an anti-panic unlocking control to said logic control unit, said logic control unit being configured to switch said clamping device to said unlocked mode upon receiving said anti-panic unlocking control.

5. System according to claim 1, wherein said container comprises means to detect the presence of a cigarette pack inside said container.

6. System according to claim 1, wherein said wireless communicating modules are of Bluetooth type.

7. System according to claim 1, wherein said container comprises sensor means to detect the opening and closing of said container.

8. System according to claim 1, wherein said clamping device comprises at least one locking element arranged on a first portion of the container and adapted to be engaged in a respective seat arranged on a second portion of the container such that said locked mode is achieved, said clamping device further comprising an electric actuator driven by said logic control unit to move said locking element with respect to said seat in order to switch said clamping device between said locked mode and said unlocked mode.

9. System according to claim 8, wherein said clamping device comprises a flexible rod so that said locking element remains engaged in said seat.

10. System according to claim 8, wherein said electric actuator comprises an electromagnet configured to attract towards itself said locking element so that said clamping device is maintained in said unlocked mode.

11. System according to claim 8, wherein said clamping device comprises a permanent magnet arranged to exert a magnetic force on said locking element such that said clamping device is maintained in said locked mode when said locking element is engaged in said seat.

12. System according to claim 11, wherein said clamping device comprises a spring arranged to exert an elastic force on said locking element such that said clamping device is brought to said unlocked mode when said locking element is disengaged from said seat.

13. System according to claim 12, wherein said spring exert an elastic force smaller than the magnetic force produced by said permanent magnet when said locking element is engaged in said seat.

14. System according to claim 13, wherein said electric actuator comprises an electromagnet arranged to produce a magnetic field adapted to counteract the magnetic field produced by said permanent magnet.

15. Method of dispensing cigarettes in a controlled way through a system according to claim 1, said method comprising the steps of:

a) determining the dependence level of a user through the Fagerström test;

b) automatically setting at least one time sequence comprising at least one dispensation time interval on said processing device depending on the dependence level determined in said step a);

c) transmitting, by means of said wireless communicating module, said time sequence from said processing device to said logic control unit of the container to program the timer of said logic control unit;

d) switching the clamping device to the unlocked mode upon receiving an unlocking request;

said step d) being carried out if said unlocking request occurs during said at least one dispensation time interval.

16. Method according to claim 15, further comprising a step f) detecting the presence and the absence of a cigarette pack inside the container and a step g) determining the number of openings of said container which occurred between the detection of the presence of the pack inside the container and the detection of the absence of the pack inside the container, said method further comprising a step h) warning the user if said number of openings, determined in said step g), is lower than twenty.

17. Method according to claim 15, further comprising step e) recording the openings of said container which are carried out during at least one detection time interval.

18. Method according to claim 17, wherein said step a) is carried out at least partially through an interface of the processing device.

19. Method according to claim 17, wherein part of the answers of said Fagerström test are automatically obtained by the processing device depending on the openings recorded during a first detection time interval of said step e).

20. Method according to claim 18, wherein said at least one time sequence set in said step b) is modified depending on the openings recorded during at least one second detection time interval of said step e).

* * * * *